US007376052B2

(12) United States Patent
Sela

(10) Patent No.: US 7,376,052 B2
(45) Date of Patent: May 20, 2008

(54) CLOCK HAVING A LINEAR ARRAY OF GRADUATIONS AND LIGHT BANDS INDICATING HOURS, MINUTES, AND SECONDS

(76) Inventor: Eliot J. Sela, 220 W. 21st St., New York, NY (US) 10011

( * ) Notice: Subject to any disclaimer, the term of this patent is extended or adjusted under 35 U.S.C. 154(b) by 61 days.

(21) Appl. No.: 11/386,036

(22) Filed: Mar. 21, 2006

(65) Prior Publication Data

US 2006/0256663 A1 Nov. 16, 2006

Related U.S. Application Data

(60) Provisional application No. 60/664,148, filed on Mar. 22, 2005.

(51) Int. Cl.
*G04B 19/00* (2006.01)

(52) U.S. Cl. ..... 368/82; 368/223

(58) Field of Classification Search ..... 368/82, 368/223

See application file for complete search history.

(56) References Cited

U.S. PATENT DOCUMENTS

| | | | | |
|---|---|---|---|---|
| 3,574,992 | A * | 4/1971 | Ladas | 368/82 |
| 3,587,222 | A * | 6/1971 | Mestrovic | 368/78 |
| 3,956,879 | A * | 5/1976 | Bailey | 368/76 |
| 4,161,098 | A * | 7/1979 | Ingendahl | 368/76 |
| 4,752,919 | A * | 6/1988 | Clark | 368/223 |
| 5,214,624 | A * | 5/1993 | Siebrasse | 368/82 |
| 5,526,327 | A * | 6/1996 | Cordova, Jr. | 368/82 |
| 6,249,486 | B1 * | 6/2001 | Chitturi | 368/21 |
| 6,256,265 | B1 * | 7/2001 | Sepulveda | 368/82 |
| 6,256,625 | B1 * | 7/2001 | Breyer et al. | 707/3 |
| 6,690,623 | B1 * | 2/2004 | Maano | 368/82 |
| 6,711,101 | B2 * | 3/2004 | Bornovski | 368/223 |

* cited by examiner

*Primary Examiner*—Gary F. Paumen
(74) *Attorney, Agent, or Firm*—Ladas & Parry

(57) ABSTRACT

A clock including a screen having graduations therealong representing time periods, and light bands representing hours, minutes and seconds hands traveling along the screen to indicate current time. When at least two of the three hands overlap one another, light flashes are displayed.

24 Claims, 18 Drawing Sheets

CLOCK HAVING A LINEAR ARRAY OF GRADUATIONS AND LIGHT BANDS INDICATING HOURS, MINUTES, AND SECONDS

This application claims the benefit of U.S. Provisional Application No.: 60/664,148 filed Mar. 22, 2005 and incorporates the same by reference.

FIELD OF THE INVENTION

The invention relates to a clock for displaying time and producing visual patterns when at least two of the hour, minute, and second indicators cross one another.

The invention further relates to methods of displaying time.

BACKGROUND AND PRIOR ART

Means for displaying time, such as clocks, watches and the like, are well known. From the ancient sundial to modern digital clocks, many different configurations and ways of displaying time have been contemplated throughout history.

There are two general forms of clocks. One is the more traditional analog clock in which the hour, minute, and second hands rotate about a center. An example of this form of clock is the clock on Big Ben in London, England. The other is the more modern digital clock which numerically displays the hours, minutes, and seconds. Typically, this form of clock displays a six-digit representation of time, which is generally displayed by six seven-segment displays.

Aside from the aesthetic design of the clock face or the housing, conventional clocks only display time. Furthermore, conventional clocks generally do not provide any visually stimulating and exciting displays to attract people to view the clock at certain times.

SUMMARY OF THE INVENTION

An object of the invention is to provide a device for indicating time (hereafter referred to as a clock) which displays a unique visual pattern.

Another object of the invention is to make the visual pattern easily recognizable as representing actual time of day or night.

A further object of the invention is to produce special visual features when certain time periods take place.

A feature of the invention is to produce such a visual feature when at least two of the hour, minute, and second indicators coincide with one another.

A further feature of the invention is to produce a special visual feature when all three of the hour, minute, and second indicators coincide.

In a preferred embodiment, the clock displays a flash of light when at least two of the hour, minute, and second indicators cross one another.

The above and further objects of the invention are achieved by a clock which comprises a rectangular screen with graduations along its length representing time periods and a plurality of progressively movable light bands traveling along the screen to indicate hours, minutes, and seconds of time respectively.

In another preferred embodiment, the light bands are of different color.

In another preferred embodiment, the light bands are of different size.

In accordance with the invention, when one light band overlaps another, a plurality of light flashes are produced.

In further accordance with the invention, the light flashes travel in opposite directions on the screen to the ends thereof.

In a preferred embodiment, when all three light bands overlap, an even more elaborate display of light flashes is produced.

In a preferred embodiment, a sound display accompanies the light flashes.

In accordance with another aspect of the invention, a method for displaying time is provided which comprises providing a clock face having successive graduations thereon representing hours, minutes, and seconds; advancing three bands respectively representing hours, minutes, and seconds along the clock face at respective speeds in correspondence with hours, minutes, and seconds of real time and providing indicia on the clock face indicative of hours, minutes, and seconds such that the positions of the bands on the clock face indicate time of day.

In further accordance with the invention, the method includes forming the graduations along a rectangular display.

In further accordance with the invention, the method includes forming the bands as light bands.

In a preferred embodiment, the method includes producing a display of light flashes when at least two of the bands of light representing hours, minutes, and seconds overlap.

In another preferred embodiment, the method includes producing a more intense display of light flashes when the bands of light representing hours, minutes, and seconds all overlap one another.

DETAILED DESCRIPTION

Reference is now made to FIGS. 1-9 which show a preferred embodiment of the invention.

Figure 1:
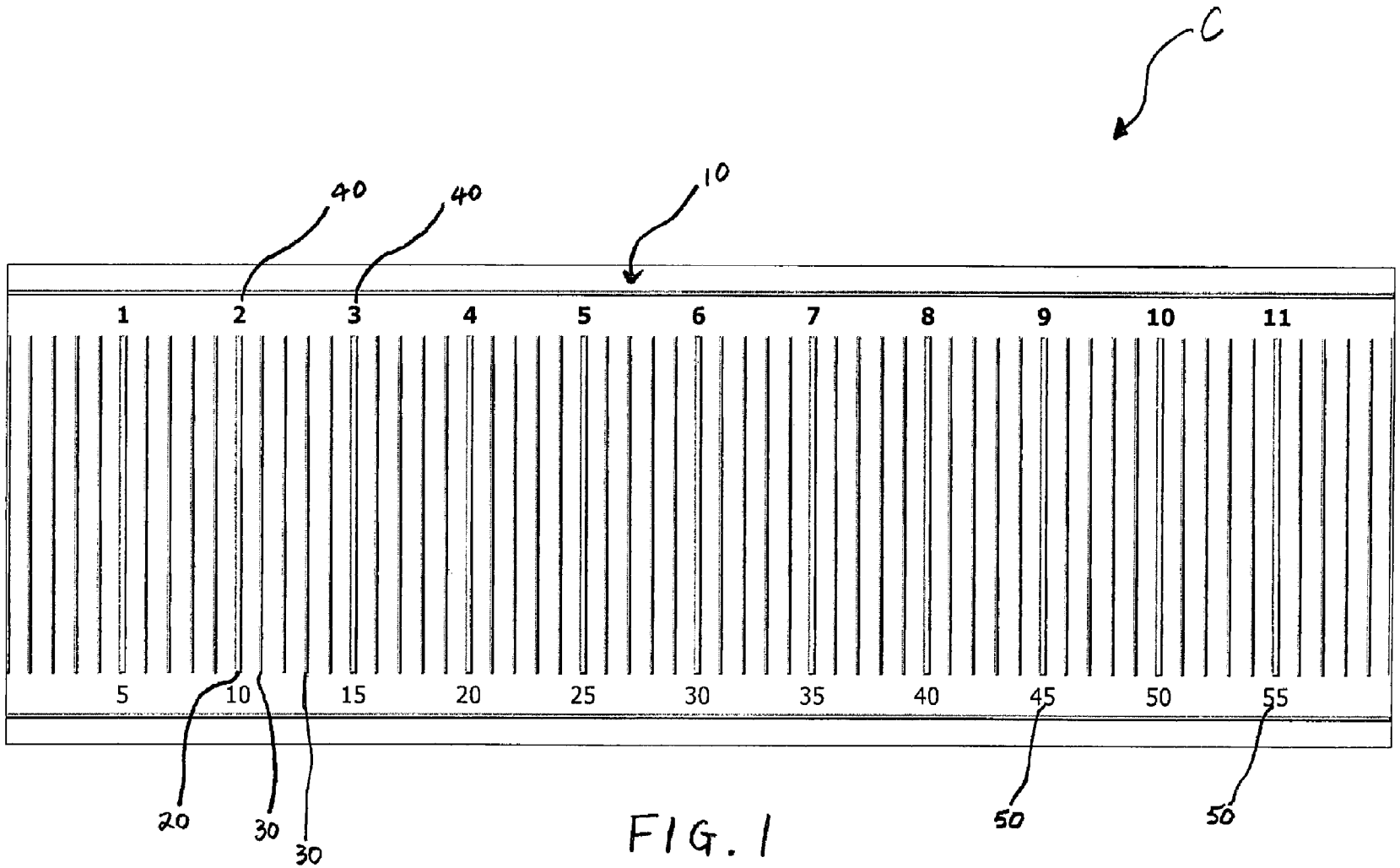
FIG. 1 is front view of a preferred embodiment of the invention showing the face of the clock.

FIG. 1 shows a face (10) of a clock (C) according to the invention without hour, minute, and second hands. The face (10) is formed by a rectangular screen with a linear array of graduations, or ticks, along its length representing time periods. The graduations begin with one half of a larger tickmark (20) followed by four narrower spaced tickmarks (30), which are then followed by another larger tickmark (20) which are in turn followed by four smaller spaced tickmarks (30). The pattern of one larger tickmark (20) followed by four smaller spaced tickmarks (30) repeats across the rectangular screen and ends with another half of a larger tickmark (20). The two halves of a larger tickmark at both ends of the rectangular screen represent the same time-space location, corresponding to "0", "12", or "60". The larger tickmarks (20) are numbered 1-11 thereabove, representing hours, and are numbered 5-55 in intervals of five therebelow, representing minutes and seconds.

In a preferred embodiment, the hour-numbers (40) are shown in bold typeface and the minute/second-numbers (50) are shown in light typeface.

Figure 2:
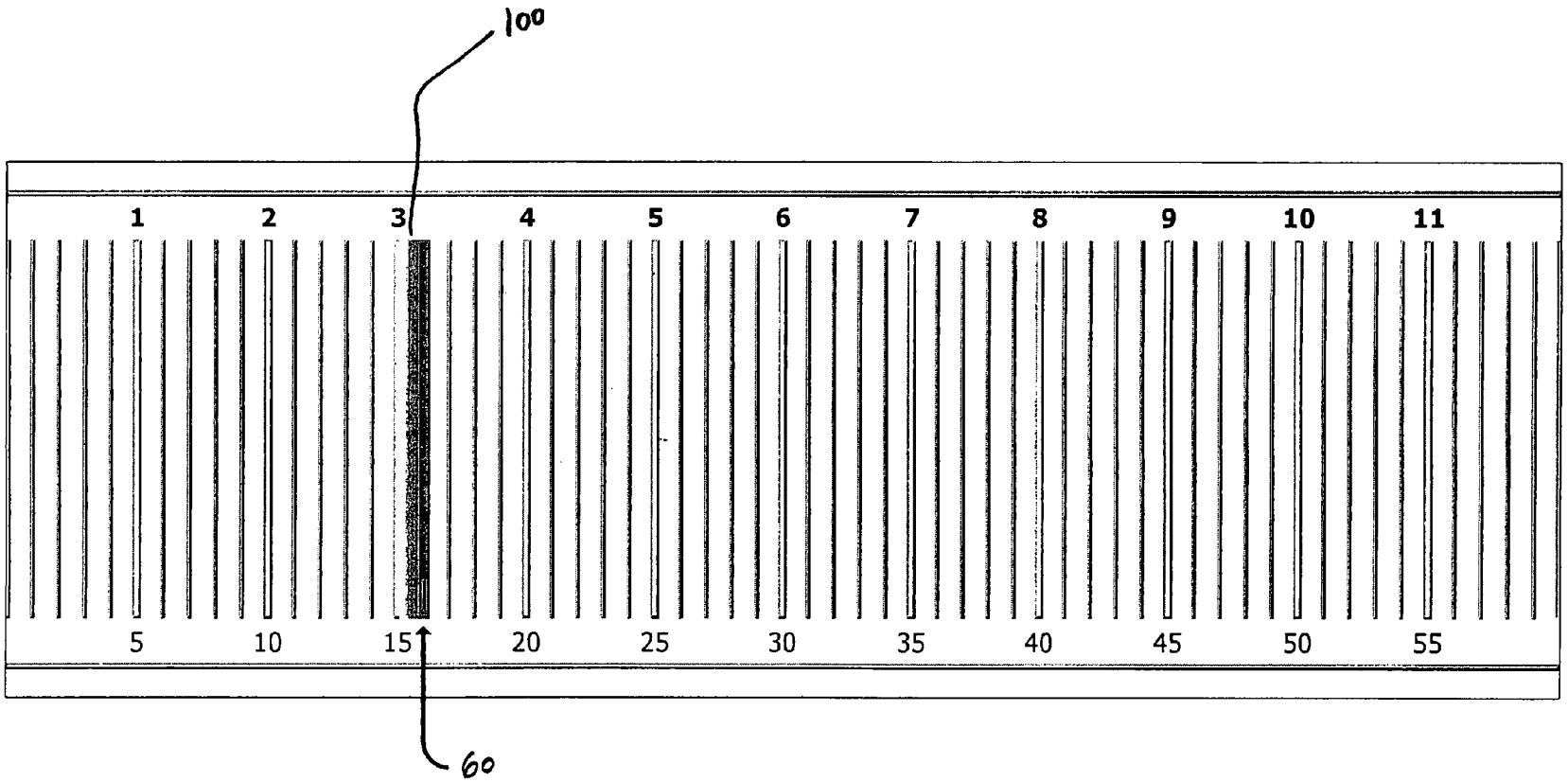
FIG. 2 shows the clock face of FIG. 1 with a second hand illustrating 16 seconds.

Shown in FIG. 2 is the face (10) shown in FIG. 1 with a second hand (60) represented by a light band covering the first smaller tickmark after the larger tickmark 15 and represents 16 seconds. A trail (100) is shown in the space between the larger tickmark 15 and the first smaller tickmark, illustrating the sweeping second hand. In this preferred embodiment, the second hand (60) is the narrowest of the three hands and may be red.

Figure 3:
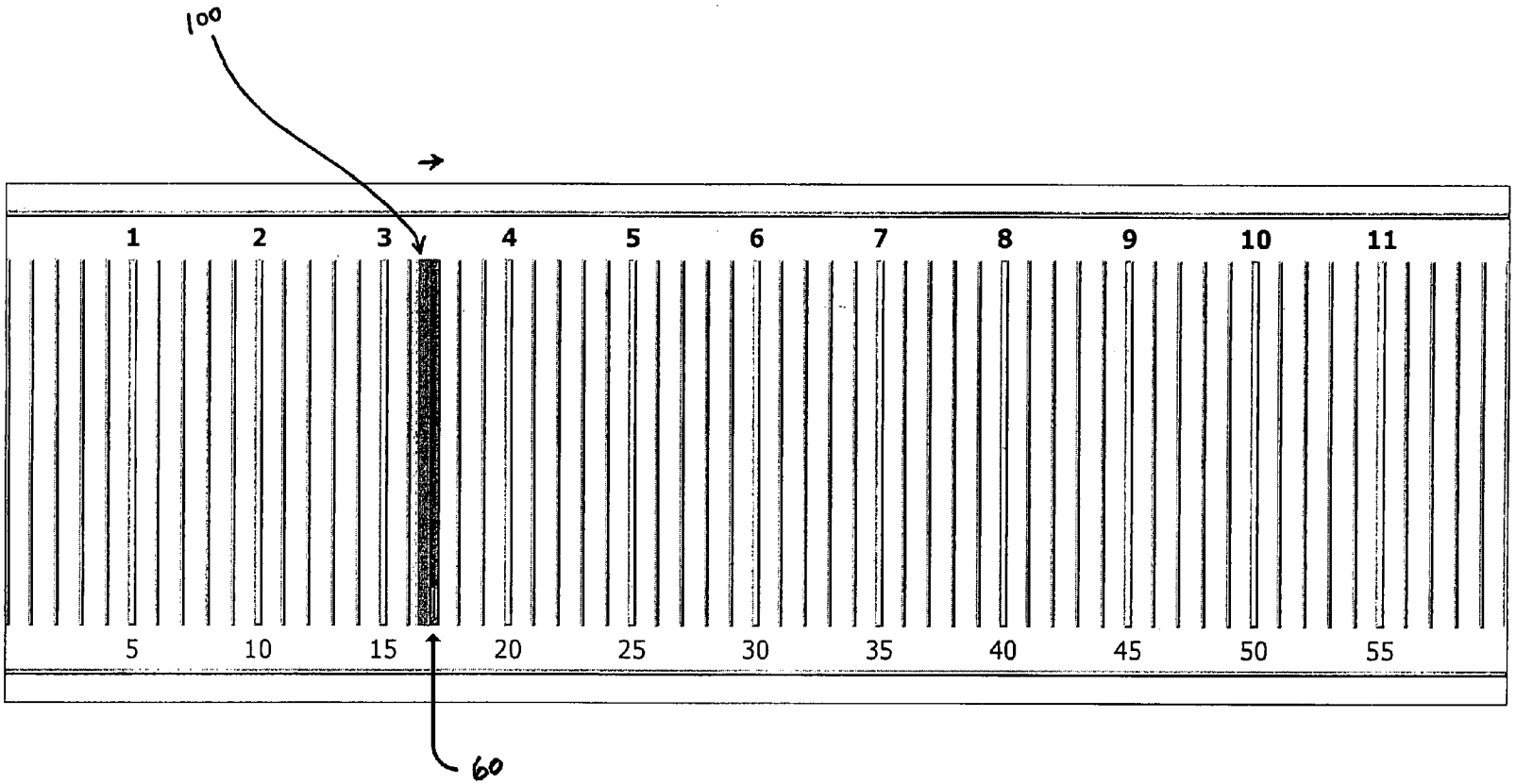
FIG. 3 shows the second hand of FIG. 2 moving to the next position at 17 seconds.

As the clock "ticks", each hand jumps in increments from bar to bar of the graduation. This is illustrated in FIG. 3 in which the second hand (60) jumped from 16 seconds to 17 seconds in the direction of the arrow. Similar arrows will appear in the following figures to show the movement of the respective hand.

Figure 4:
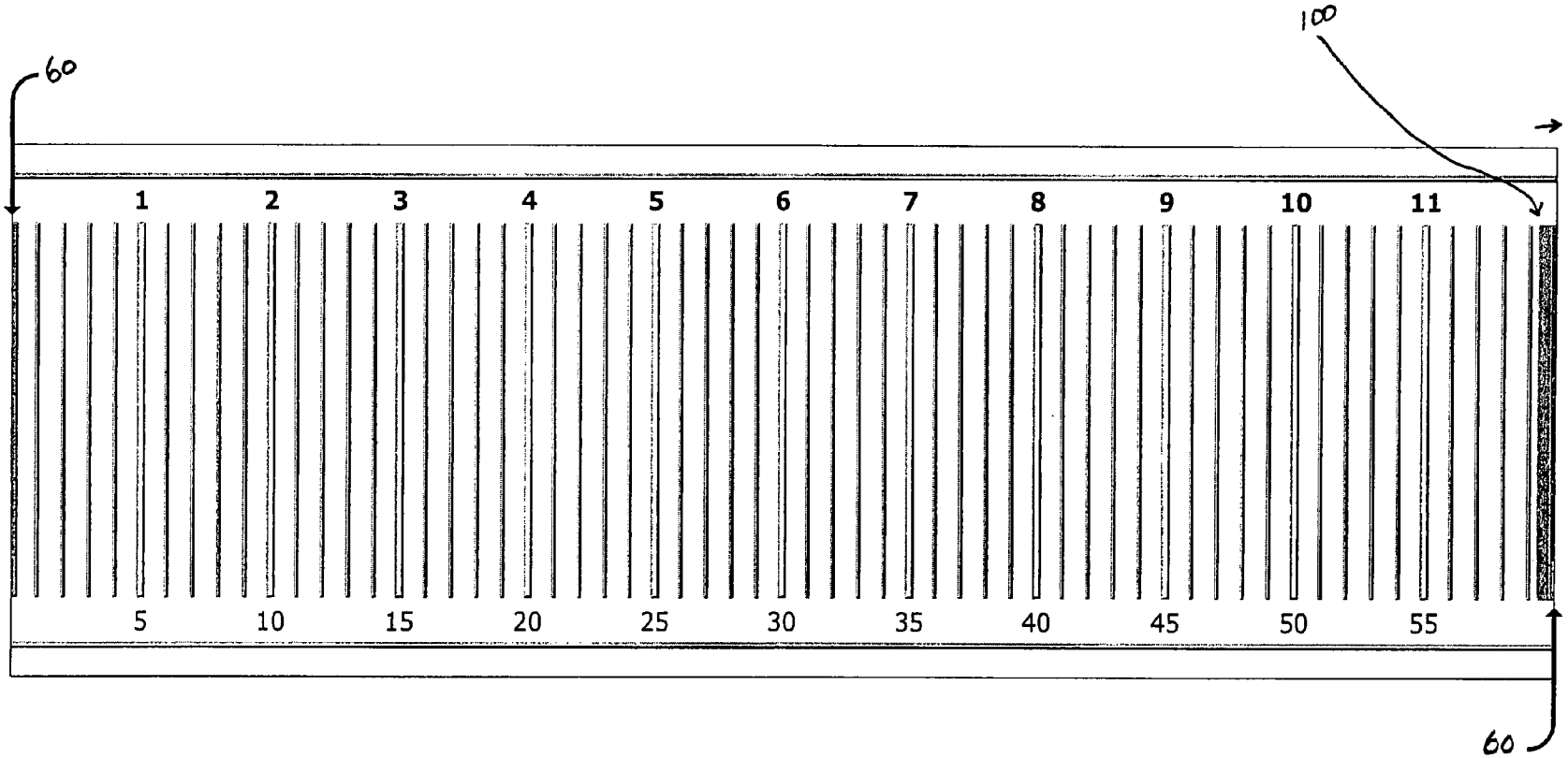
FIG. 4 shows the second hand of FIG. 2 at the "60/0" position.

As shown in FIG. 4, one-half of the second hand (60) appears at tickmark "60" and the other half appears at tickmark "0" at the beginning and end of each minute.

Figure 5:
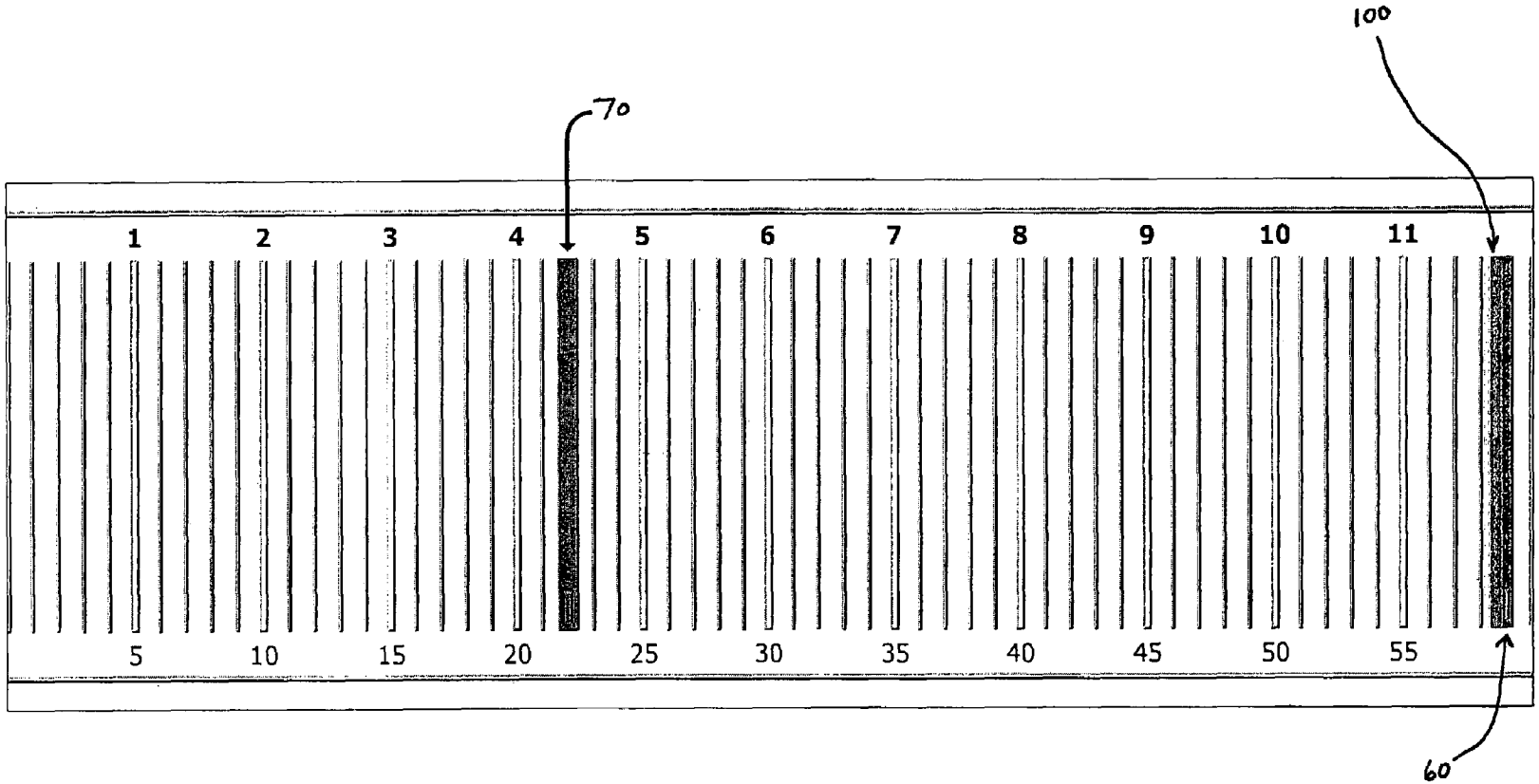
FIG. 5 shows the clock face of FIG. 1 with minute and second hands illustrating 22 minutes and 59 seconds.

Shown in FIG. 5 is the clock face of FIG. 1 with a minute hand (70) represented by a light band at 22 minutes and the second hand (60) at 59 seconds. In this preferred embodiment, the minute hand (70) is wider than the second hand (60), but narrower than the hour hand. In a preferred embodiment, the minute hand (70) is blue.

Figure 6:
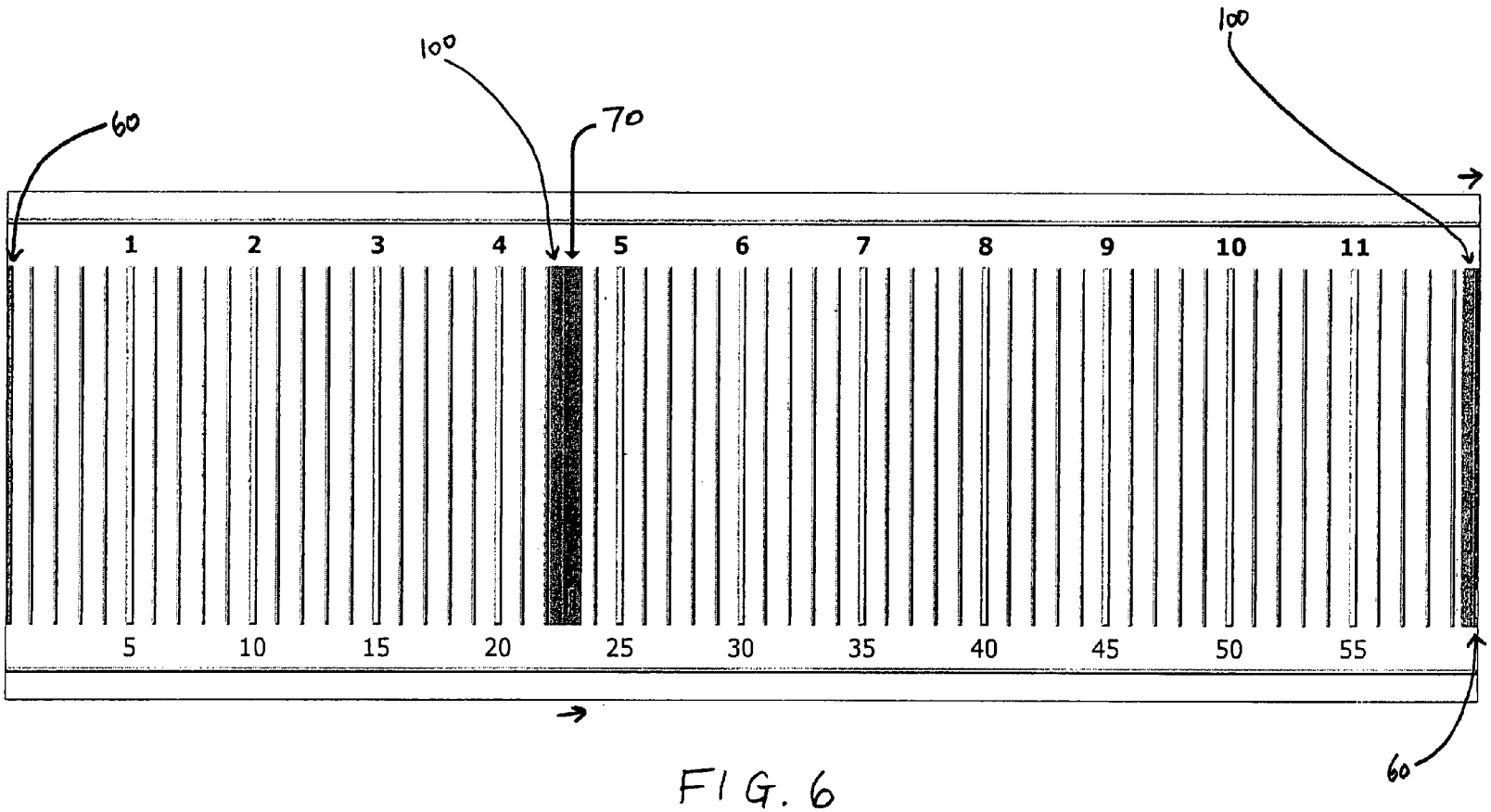
FIG. 6 shows the minute and second hands of FIG. 5 advancing to the next position at 23 minutes and 0 seconds.

FIG. 6 shows the sweeping of the minute hand (70) to 23 minutes and the sweeping of the second hand (60) as the second hand (60) reaches the "60/0" tickmark, following the time shown in FIG. 5.

Figure 7:
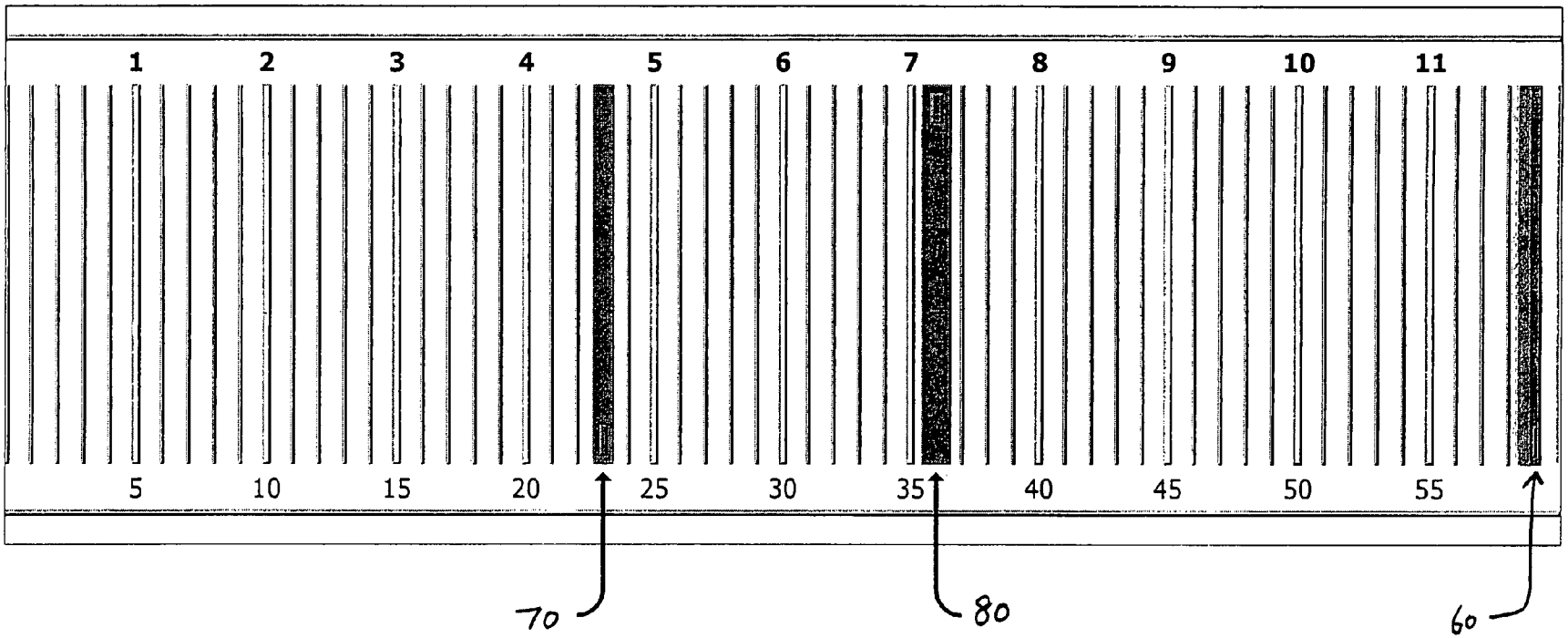
FIG. 7 shows the clock face of FIG. 1 with hour, minute, and second hands illustrating 7 hours, 23 minutes and 59 seconds.

Shown in FIG. 7 is the clock face of FIG. 1 with an hour hand (80) represented by a light band at 7 hours, the minute hand (70) at 23 minutes, and the second hand (60) at 59 seconds. In a preferred embodiment, the hour hand (80) is the widest of the three hands, and may be green.

Figure 8:
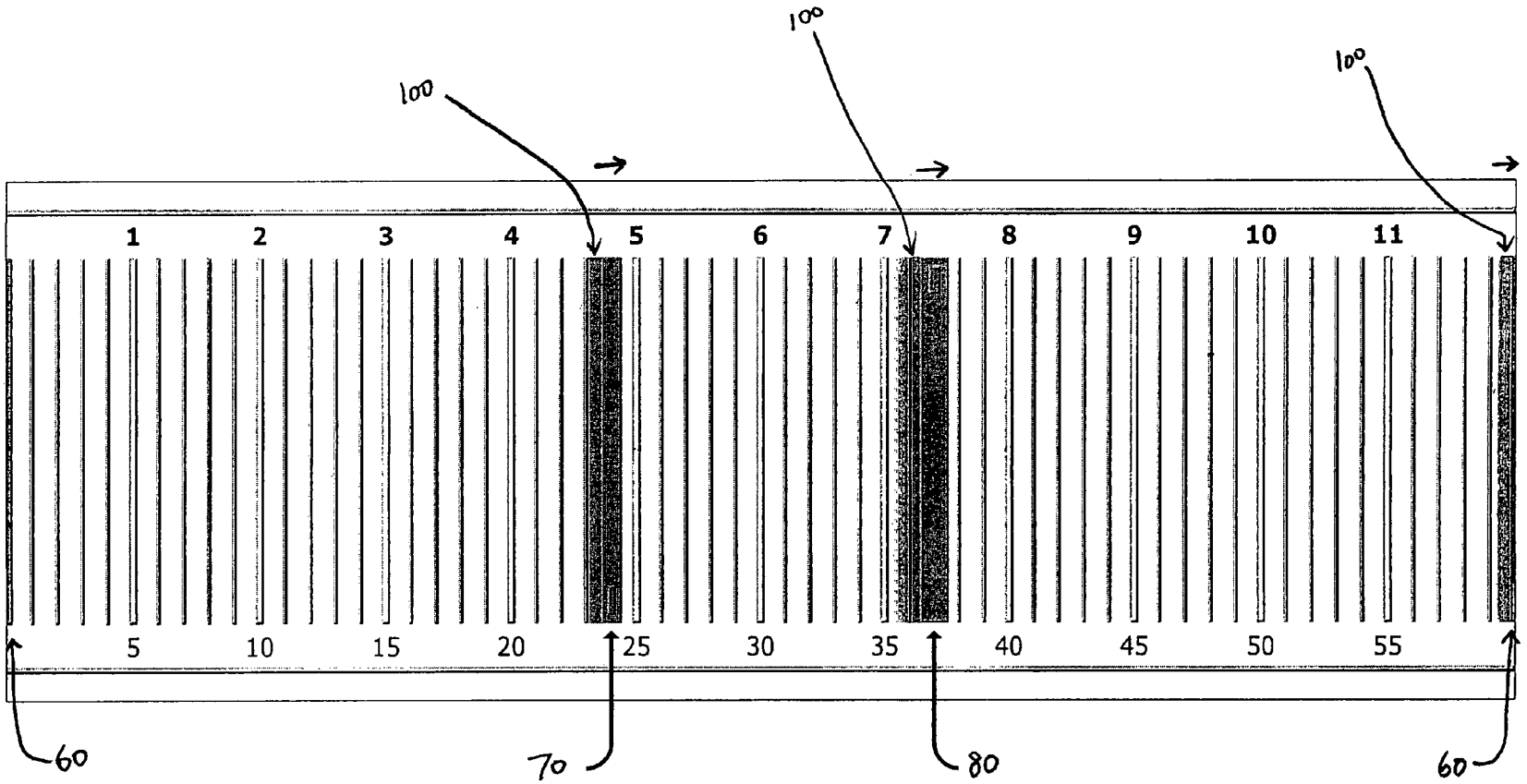
FIG. 8 shows the hands of FIG. 7 moving to the next position at 7 hours and 24 minutes and 0 seconds.

Following FIG. 7, as the clock ticks to the next second to 7 hours and 24 minutes as shown in FIG. 8, the second hand (60) advances to the "60/0" tickmark and the minute hand (70) advances to the "24" tickmark as explained above, and the hour hand also advances from the first smaller tickmark after 7 to the next smaller tickmark.

Figure 9:
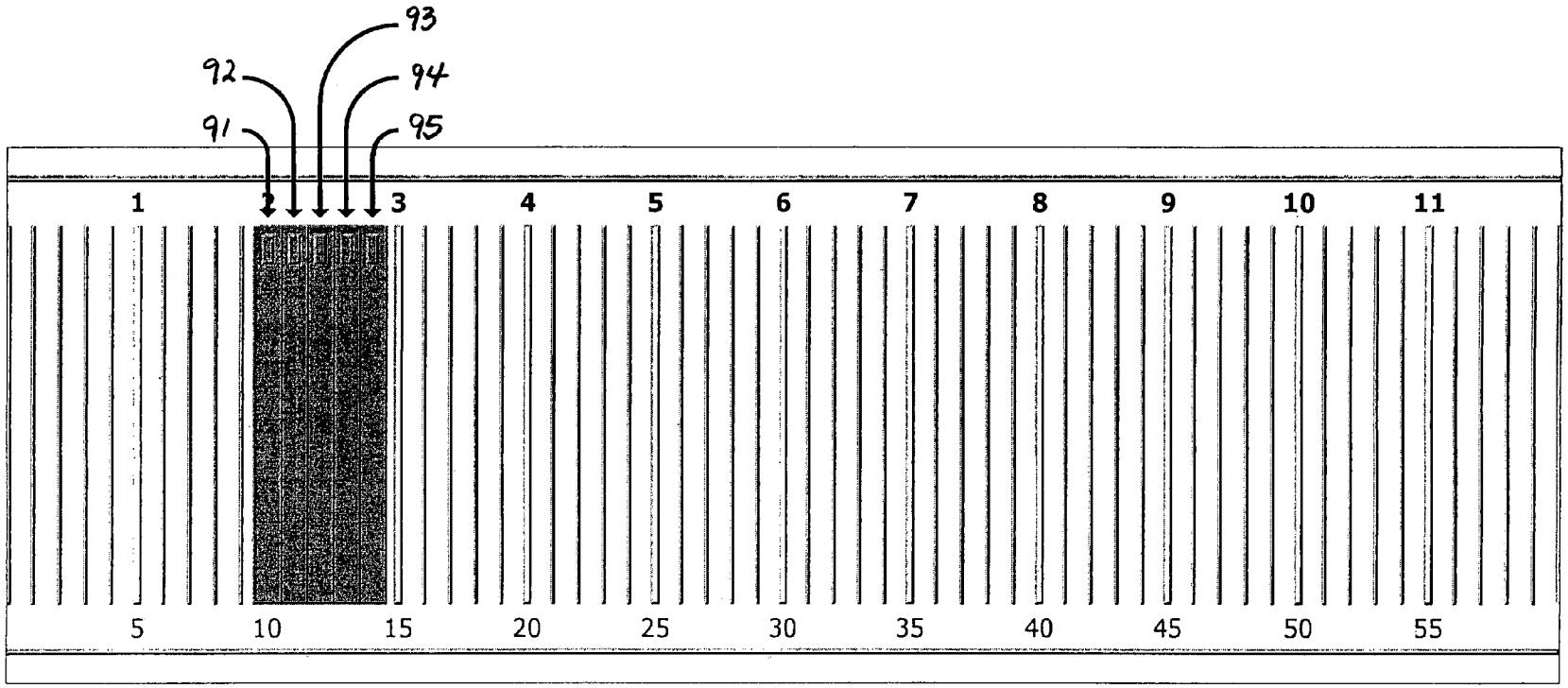
FIG. 9 shows the clock face of FIG. 1 in which the five intervals and the corresponding portion of the hour as occupied by the respective hour hand.

As each hour is divided into five intervals, each interval corresponds to a respective portion of the hour. The five intervals are shown in FIG. 9 in which the first interval (91) corresponds to 0-11 minutes past the hour, the second interval (92) corresponds to 12-23 minutes past the hour, the third interval (93) corresponds to 24-35 minutes past the hour, the fourth interval corresponds to 36-47 minutes past the hour, and the fifth interval corresponds to 48-59 minutes past the hour.

Figure 10:
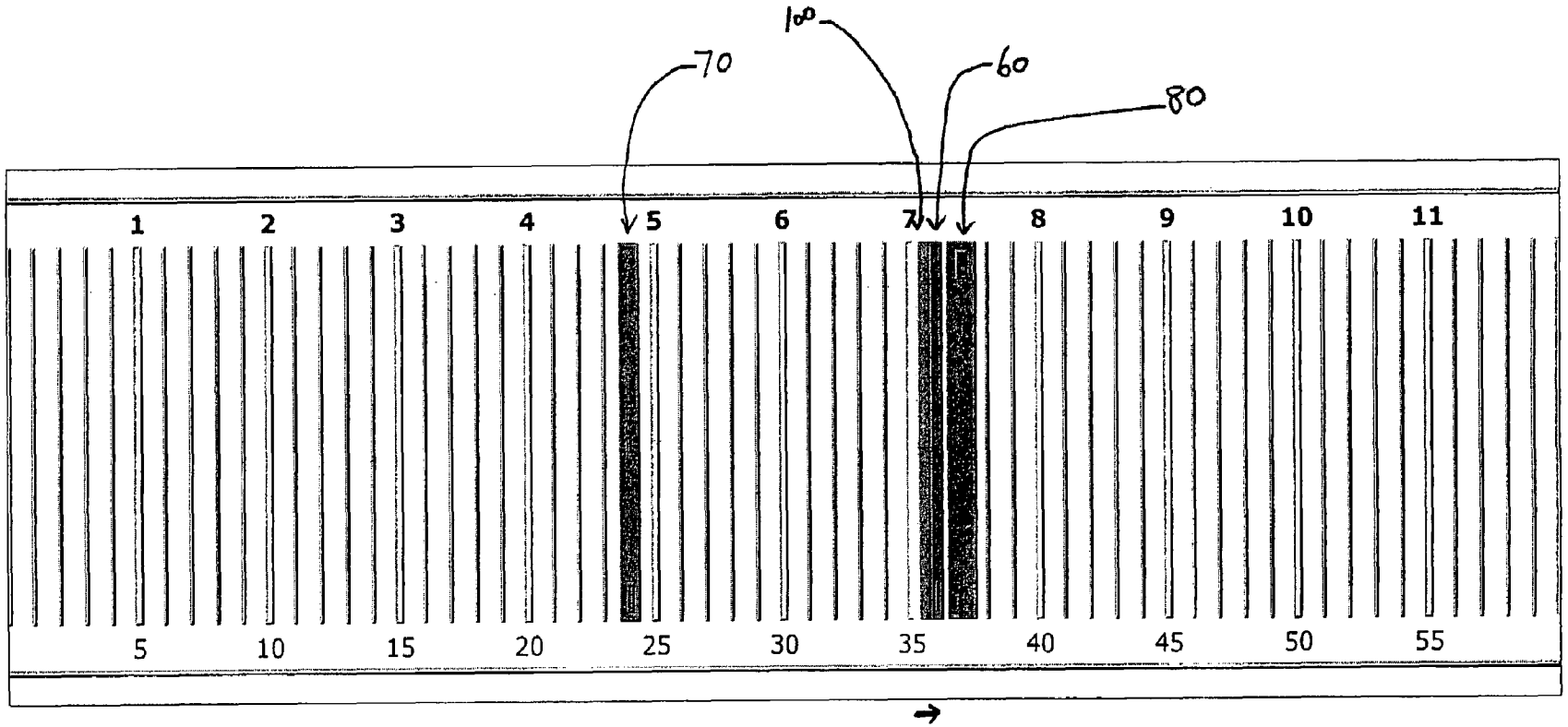
FIG. 10 shows the clock face of FIG. 1 in which the hands are at 7 hours, 24 minutes, and 36 seconds.
Figure 11:
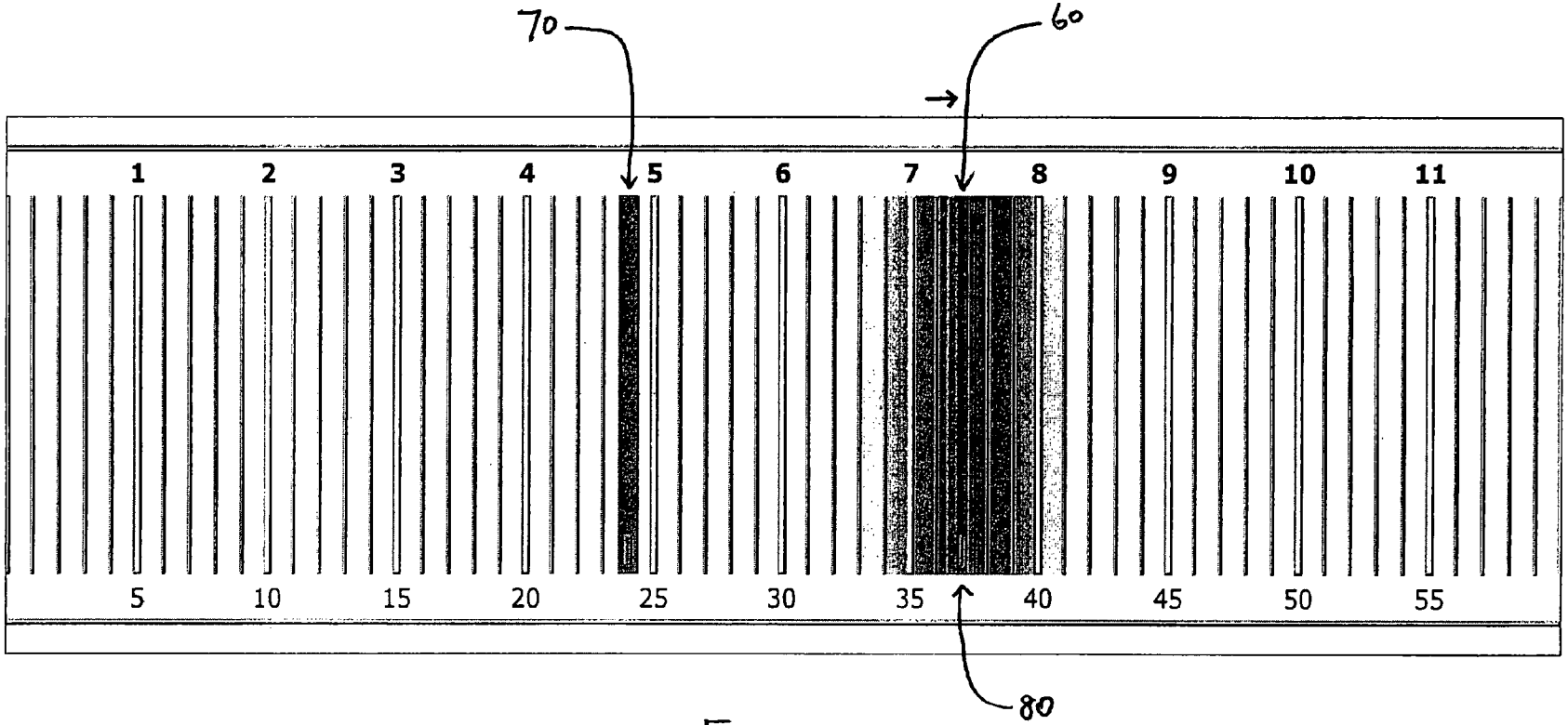
FIG. 11 shows the hour and second hands overlapping at 7 hours, 24 minutes, and 37 seconds and an accompanying flash of light.
Figure 12:
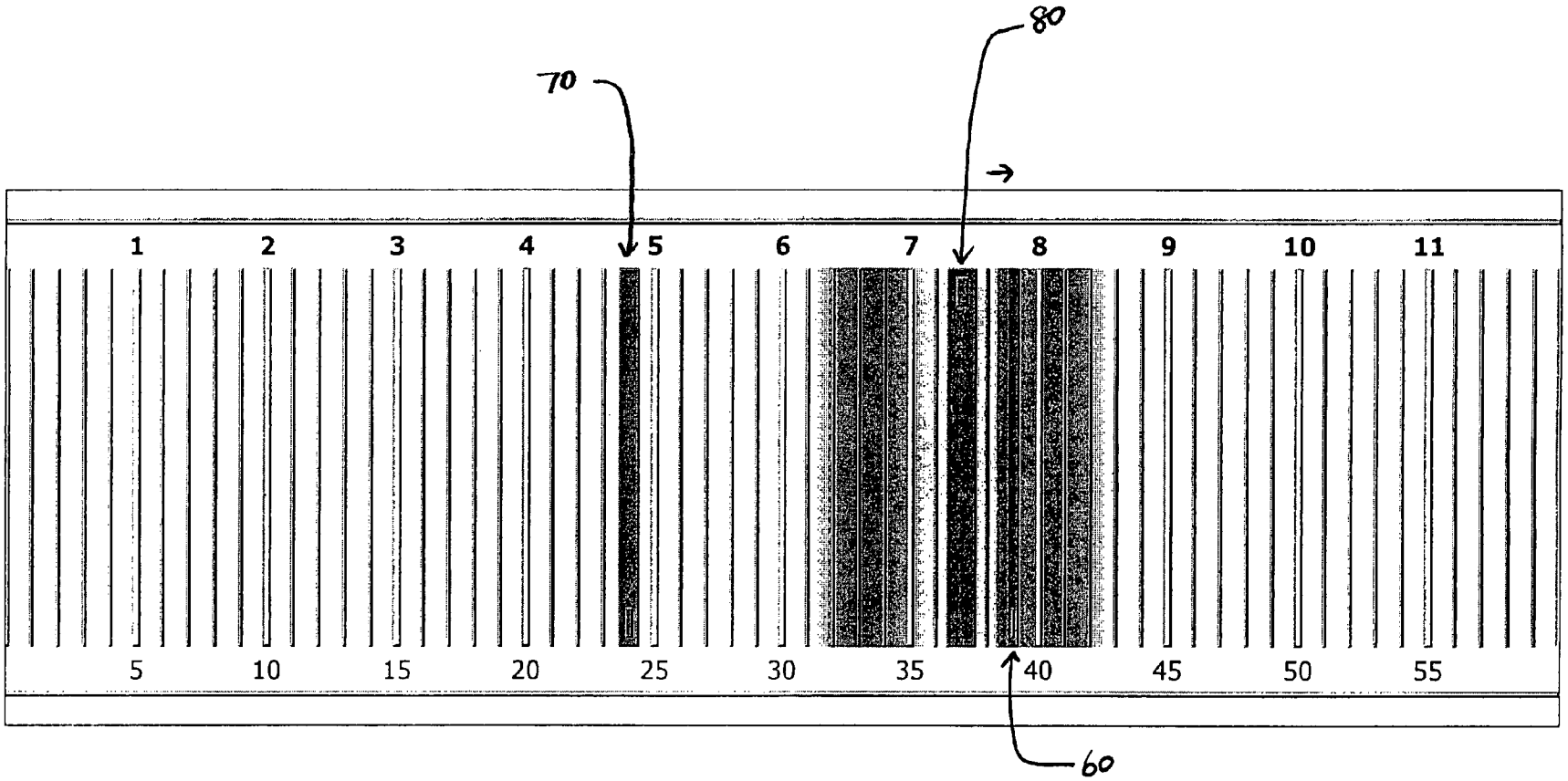
FIG. 12 shows the clock face of FIG. 1 in which the flash of light continues from FIG. 13 at 7 hours, 24 minutes, and 39 seconds.

Referring now to FIGS. 10-12, a preferred embodiment of the visual pattern which is produced when two hands overlap will be discussed hereafter.

FIG. 10 shows the clock at 7 hours, 24 minutes, and 36 seconds. As the second hand (60) advances to 37 seconds, the second hand (60) and the hour hand (80) overlap one another as illustrated in FIG. 11. As the overlap occurs, a burst of flash appears to erupt from under the overlapped hands and rushes towards both sides of the clock. This burst of flash lasts for a few seconds as shown in FIG. 12 and fades away.

Figure 13:
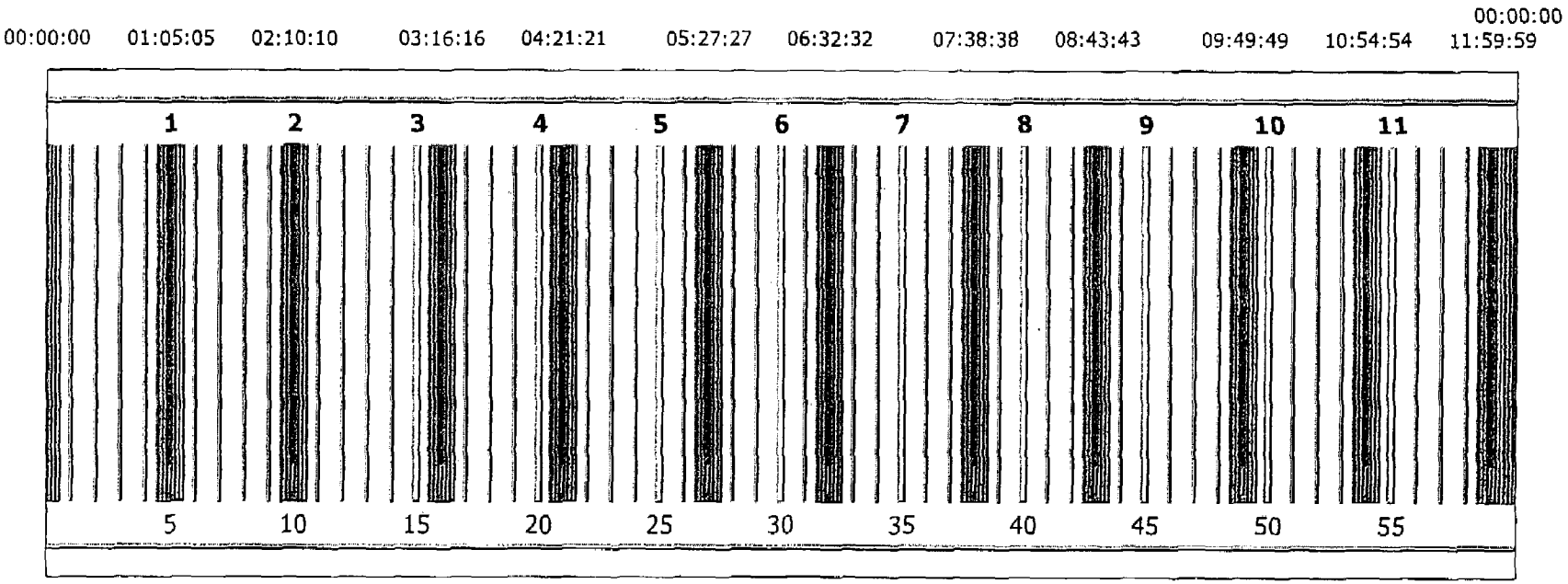
FIG. 13 shows the clock face of FIG. 1 in which the twelve times and positions of the hands when all three hands overlap.

In every 12 hour period, the three hands overlap one another 12 times. FIG. 13 shows the times and positions when the three hands overlap.

As it is relatively rarer to have the three hands overlap, it is preferable to have a more special, distinctive, colorful, long lasting, or stronger burst of flashes when this occurs. For example, the two halves of the burst of flashes may move in opposite directions toward the ends of the screen, and may emerge on the opposite side of the screen to meet the other half of the flashes which may result in another display of flashes.

Figure 14:
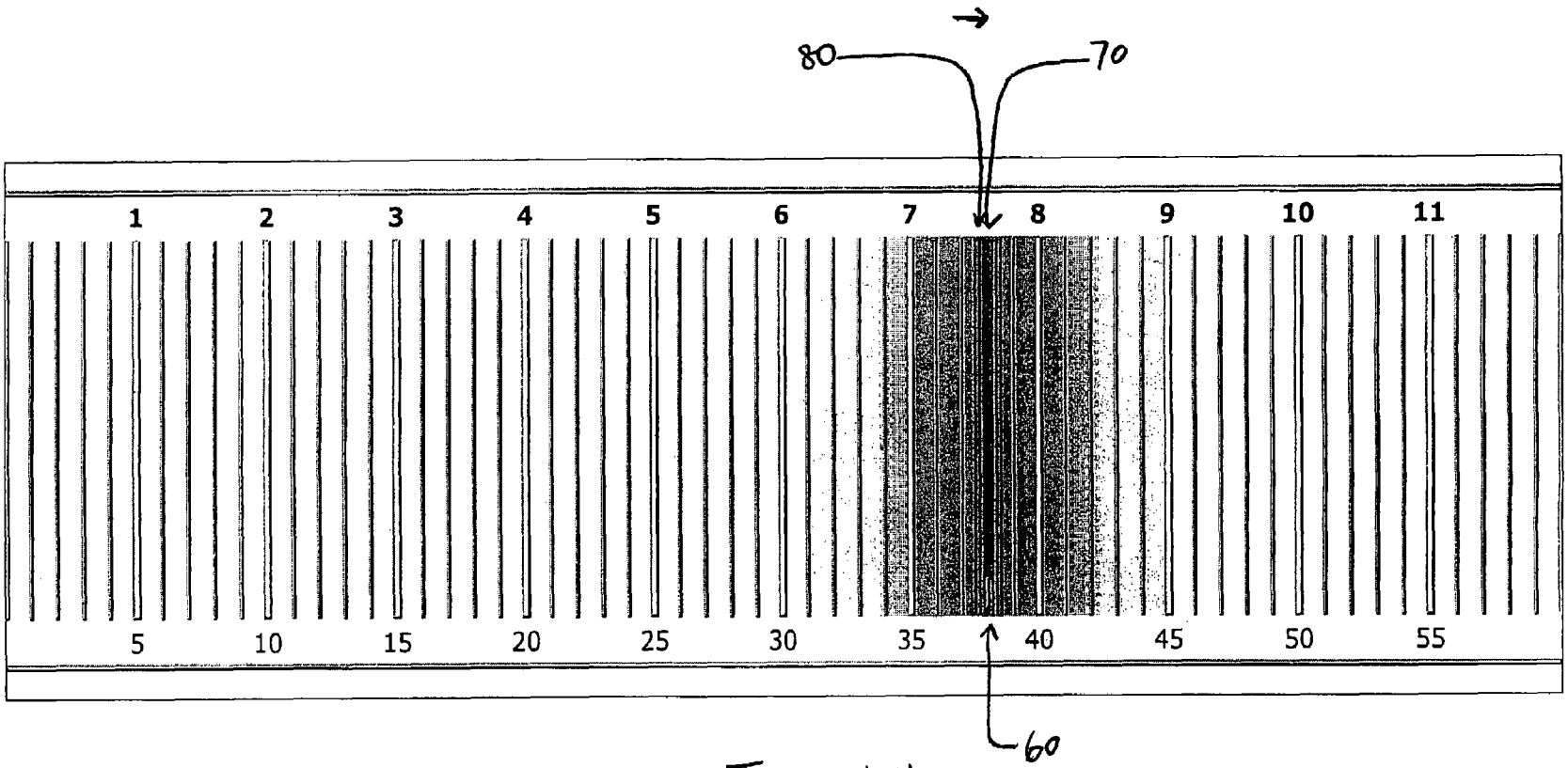
FIG. 14 shows a flash of light of a preferred embodiment when all three hands overlap.
Figure 15:
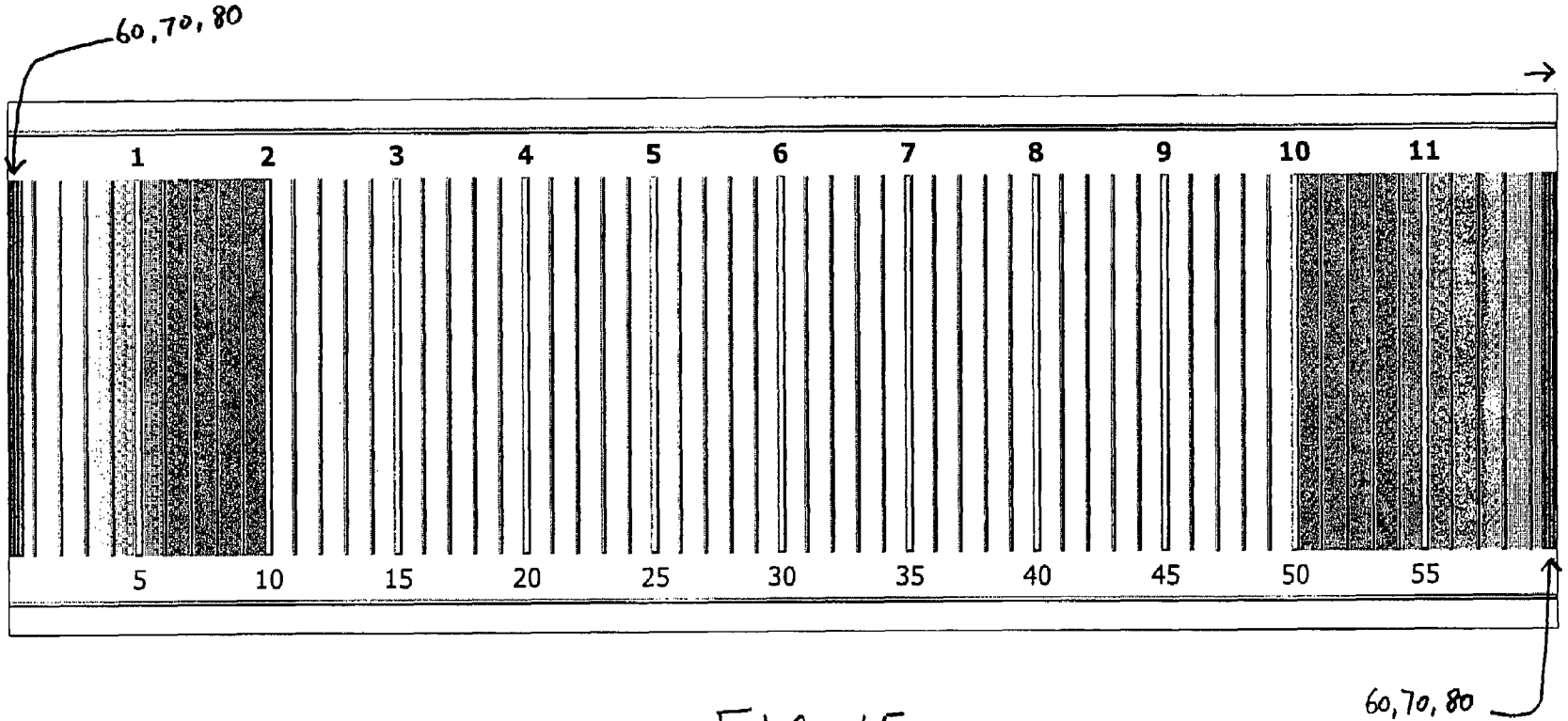
FIG. 15 shows a flash of light of a preferred embodiment at midnight.

At midnight, it is preferable to have an even more special, distinctive, colorful, long lasting, or stronger burst of flash to accompany this event as shown in FIG. 14. This midnight show would attract visitors to the clock and the area.

Although the embodiment above includes a burst or flash erupting in a linear fashion out of the overlapping hands towards both sides of the clock, other visual patterns, including different shapes, colors, and configurations of light may be displayed. The invention may also be configured or programmed such that a unique visual pattern is displayed during a special event, for example, the new year.

Figure 16:
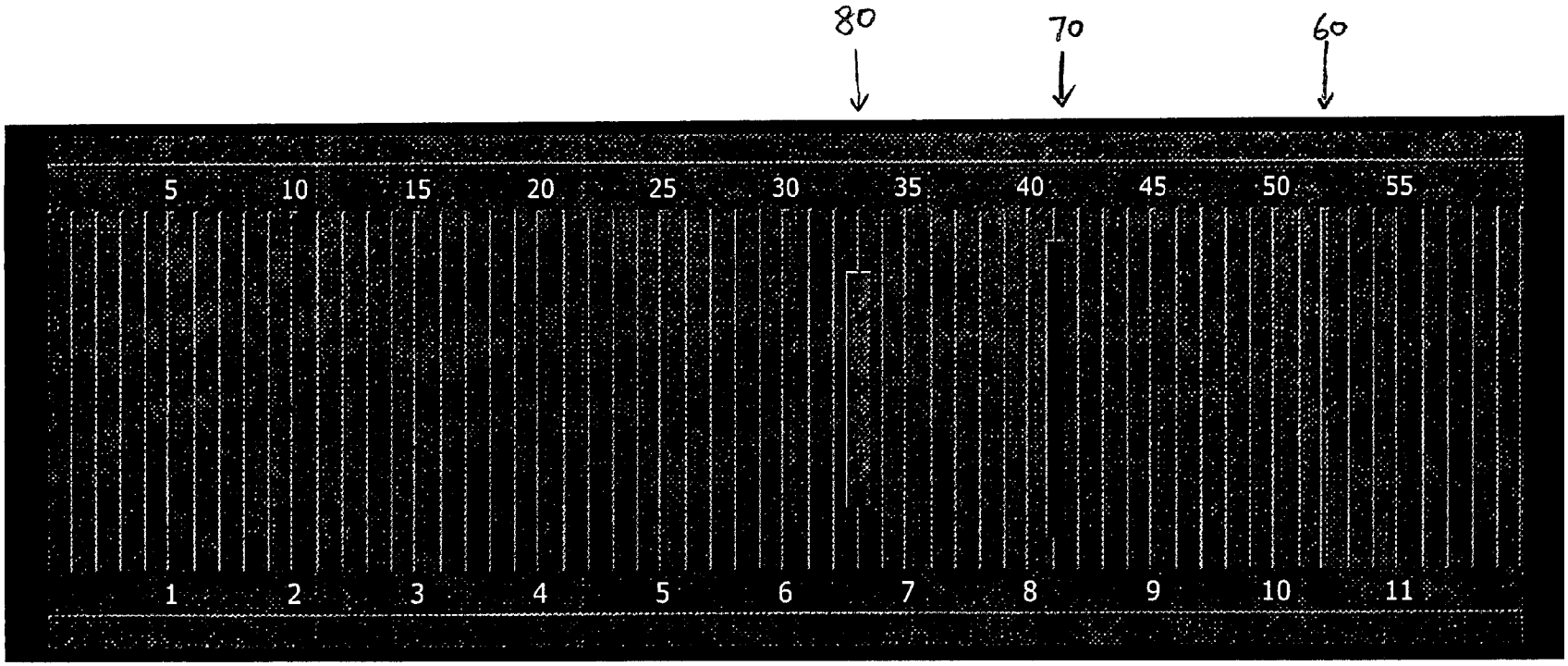
FIG. 16 shows another embodiment of the clock.

FIG. 16 shows another preferred embodiment of the invention with different hours, minutes, and seconds hands. In this embodiment, the clock has a darker clock face surrounded by a dark frame, and the hours hand is shorter than the minutes hand, which is shorter than the seconds hand.

The invention may be implemented as a large LED or LCD display or other means of displaying, such as projection screen, TV, etc., which is controlled by a computer or a controller having computer instructions to display the clock as described above.

Figure 17:
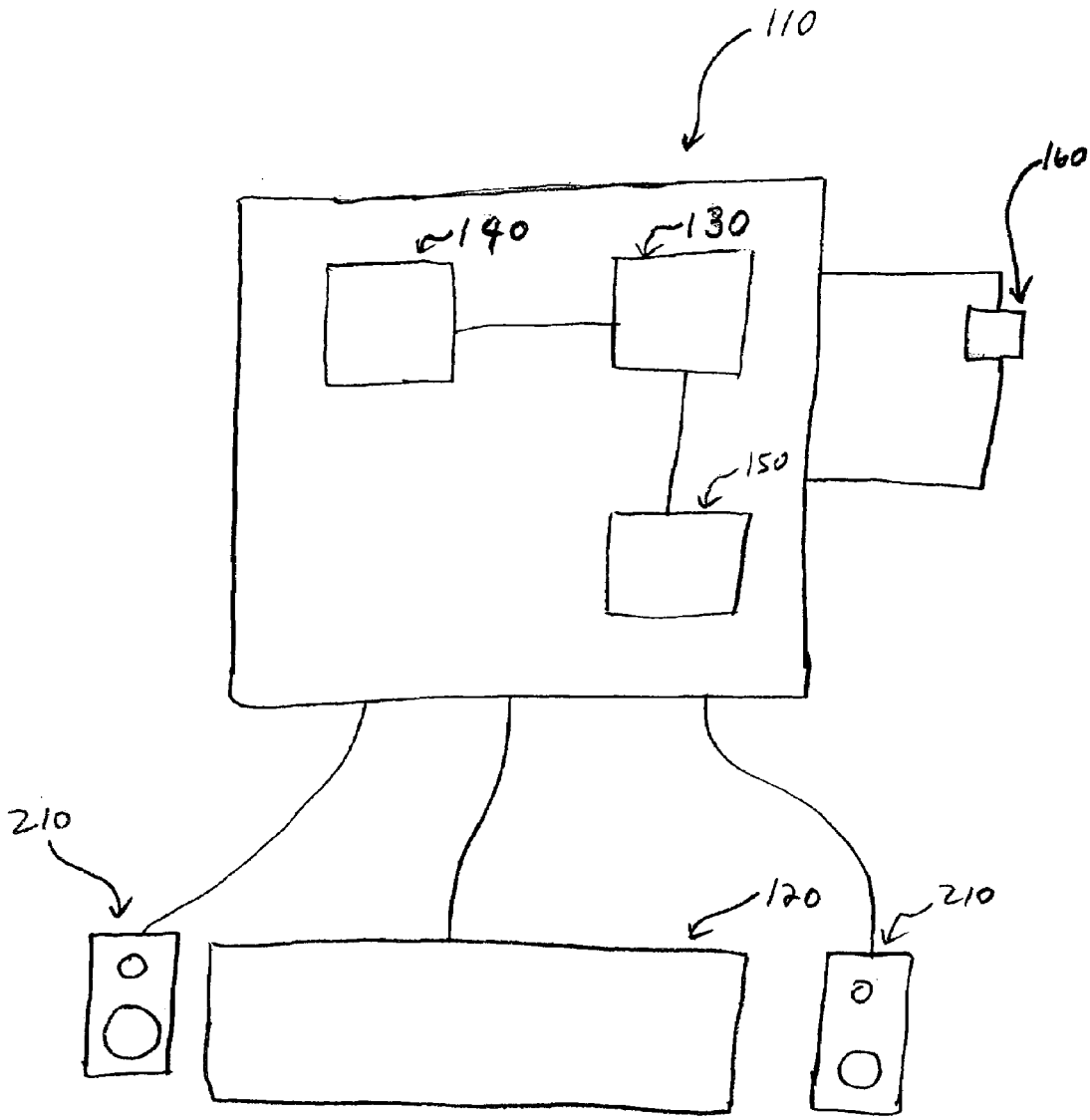
FIG. 17 is a diagrammatic illustration of apparatus for producing the time display and visual effects on the face of the clock.

For example, FIG. 17 shows a controller (110), which may be an integrated circuit layout or a personal computer, connected to a display (120) and speakers (210). The controller (110) includes a processor (130), time keeping means (140) which may be an internal quartz clock such as the Real Time Clock chip found in computers, and storage means (150) which may be a computer readable medium storing instructions for displaying the invention. The controller (110) may be connected to an external power source (160) as shown or battery driven. The display (120) and the speakers (210) may draw power from the controller or from respective power sources. The controller (110) may also include synchronizing means to synchronize the time keeping means (140) to an accurate time source such as the NIST ((National Institute of Standards and Technology) Internet Time Service.

The invention may also be implemented to be run on a personal computer for home use, or as a website which can be downloaded or broadcasted over the Internet. At the time of this application, a working example of the invention may be viewed at www.mbeshir.com/eSela/

Figure 18:
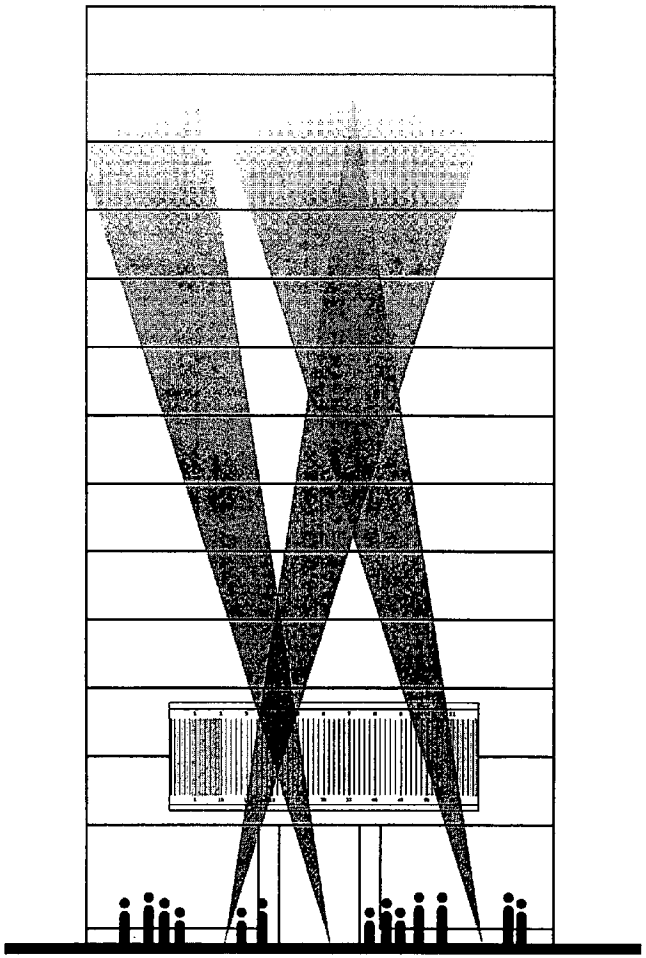
FIG. 18 shows the clock of the invention mounted at the front of a building, with accompanying lights.

As shown in FIG. 18, the clock of the invention may be incorporated at the fascia of a building, which can be accompanied by external lights. The external lights may be connected to and controlled by the controller (110). The invention may also be incorporated in other environments and become a landmark or an attraction to visitors.

Although the invention is disclosed with reference to particular embodiments thereof, it will become apparent to those skilled in the art that numerous modifications and variations can be made which will fall within the scope and spirit of the invention as defined by the attached claims.

Thus, for example, although the face of the clock has been shown with dark graduations on a white face, the arrangement can be reversed and even various combinations of different colors can also be used for the face and the graduations. Similarly, the hour, minute, and second hands (60, 70, 80) may be differentiated by being of different colors, sizes, and shapes. Additionally, although the screen has been shown as being horizontal, it may be vertical, inclined, or of arcuate shape. Also, while the screen has been shown as rectangular, it could also be curvilinear or of other shape.

The invention claimed is:

1. A clock comprising a screen having graduations therealong representing time periods, and a plurality of light bands respectively representing hours, minutes and seconds, said light bands traveling along the screen to indicate current time, wherein when one light band overlaps another, a display of light flashes is produced which travels in opposite directions to the ends of the screen.

2. The clock according to claim 1, wherein the screen is rectangular.

3. The clock according to claim 1, wherein the light bands have different visual appearance from one another.

4. The clock according to claim 3, wherein the light bands are of different color.

5. The clock according to claim 3, wherein the light bands are of different size.

6. The clock according to claim 1, wherein when the light bands representing hours, minutes, and seconds overlap, a more intense display of light flashes is produced.

7. The clock according to claim 1, comprising means for displaying sound which accompanies the light flashes.

8. A computer readable medium, said computer readable medium comprising a set of computer instructions for processing an integrated circuit layout, said computer instructions implementing the steps of:

displaying light bands respectively representing hours, minutes, and seconds traveling along a screen having graduations therealong to indicate current time, wherein when one light band overlaps another, a more intense display of light flashes is produced which travels in opposite directions to the ends of the screen.

9. The computer readable medium according to claim 8, wherein the screen is rectangular.

10. The computer readable medium according to claim 8, wherein the light bands are produced with different colors.

11. The computer readable medium according to claim 8, wherein the light bands are produced with different sizes.

12. The computer readable medium according to claim 8, wherein when the light bands representing hours, minutes, and seconds all overlap one another, a more intense display of light flashes is produced.

13. The computer readable medium according to claim 8, adapted for displaying sound along with the light flashes.

14. A method of displaying time comprising the steps of:

providing a clock face having successive graduations thereon representing hours, minutes, and seconds;

advancing three bands respectively representing hours, minutes, and seconds along said clock face at respective speeds in correspondence with hours, minutes, and seconds of real time, providing indicia on said clock face indicative of hours, minutes, and seconds such that the positions of said bands on said clock face indicate time and, producing a display of light flashes when at least two of the bands of light representing hours, minutes, and seconds overlap.

15. A method of displaying time according to claim 14, comprising forming said graduations along a rectangular display.

16. The method of displaying time according to claim 14, comprising forming the bands as light bands.

17. The method of displaying time according to claim 14, comprising producing a more intense display of light flashes when the bands of light representing hours, minutes, and seconds all overlap one another.

18. A clock comprising:

a rectangular horizontal screen having a succession of parallel, spaced vertical graduations representing time periods, beginning at a left end of the screen and extending at equal intervals to a right end of the screen, and a plurality of light bands respectively representing hours, minutes and seconds, said light bands being electronically generated to extend vertically on said screen, separate from said graduations, and travel on and across said graduations from the left end to the right end and upon reaching the right end to begin again at the left end, the travel of the light bands being coordinated with real time and with the graduations so that the light band representing seconds traverses the screen in one minute, the light band representing minutes traverses the screen in one hour and the light band representing hours traverses the screen in 12 hours such that at any instant the light bands and the graduations represent current time and in the course of 12 hours the light bands travel along the screen to overlap said graduations and one another.

19. The clock according to claim 18, wherein said light bands are electronically generated by means of a controller comprising a processor, a time keeper and a storage unit.

20. The clock according to claim 18, wherein when each of said light bands reaches the right end of the screen a portion of the light band is visible both at the right end and the left end until said light band transitions entirely to said left end.

21. The clock according to claim 20, wherein when each of said light bands reaches the last graduation at the right end of the clock, one-half the band is visible thereat and the other half of the band is visible at the first graduation at the left end of the clock.

22. The clock according to claim 20, wherein said left end and said right end both represent 12 O'clock, 0/60 minute and 0/60 second.

23. A computer readable medium, said computer readable medium comprising a set of computer instructions for processing an integrated circuit layout, said computer instructions implementing the steps of:

displaying light bands respectively representing hours, minutes, and seconds traveling along a rectangular horizontal screen having graduations therealong to indicate current time, arranging said graduations as a plurality of vertical lines spaced at equal intervals from a left end of said rectangular horizontal screen to a right end of the screen, and forming said light bands as vertical bands that travel on and over the graduations and one another.

24. The computer readable medium according to claim 23, further comprising the steps of arranging the graduations so that the graduations at the left and right ends of the screen represent 12 O'clock, 0/60 minute and 0/60 second and when each of said light bands reaches the graduation at the right end of the screen a portion of the light band becomes visible at both the right end and the left end until the light band transitions entirely to the left end of the screen.

* * * * *